US007950608B2

(12) United States Patent
Barnes

(10) Patent No.: US 7,950,608 B2
(45) Date of Patent: May 31, 2011

(54) SYSTEM, METHOD AND APPARATUS FOR RAILROAD GATE FLASHER ASSEMBLY HAVING A SEALED, RODENT-PROOF CONNECTION BETWEEN IN-PLACE FOUNDATION AND UTILITY MAST

(75) Inventor: Jamie Barnes, Louisville, KY (US)

(73) Assignee: Progress Rail Services Corp, Albertville, AL (US)

( * ) Notice: Subject to any disclaimer, the term of this patent is extended or adjusted under 35 U.S.C. 154(b) by 50 days.

(21) Appl. No.: 12/264,388

(22) Filed: Nov. 4, 2008

(65) Prior Publication Data

US 2010/0108823 A1 May 6, 2010

(51) Int. Cl.
*B61L 29/00* (2006.01)

(52) U.S. Cl. ..... 246/473.1; 246/293; 246/111; 246/125; 246/127; 52/296

(58) Field of Classification Search ..... 246/473.1, 246/293, 111, 125, 127; 52/296; 174/39
See application file for complete search history.

(56) References Cited

U.S. PATENT DOCUMENTS

| | | | | |
|---|---|---|---|---|
| 831,327 | A | 9/1906 | Daly | |
| 1,160,634 | A | 11/1915 | Maynard | |
| 1,162,657 | A | 11/1915 | Schweitzer | |
| 3,343,322 | A * | 9/1967 | Lurkis et al. | 52/298 |
| 3,599,378 | A * | 8/1971 | Kachnic | 52/29 |
| 3,952,978 | A * | 4/1976 | Reinitz | 246/477 |
| 4,090,685 | A * | 5/1978 | Pappas | 246/125 |
| 4,542,437 | A * | 9/1985 | Ellis et al. | 361/721 |
| 5,266,738 | A * | 11/1993 | MacVoy | 174/45 R |
| 5,541,363 | A * | 7/1996 | Weise et al. | 174/50 |
| 5,570,652 | A * | 11/1996 | Ferland | 114/221 R |
| 5,878,540 | A * | 3/1999 | Morstein | 52/296 |
| 6,240,689 | B1 * | 6/2001 | Haddad et al. | 52/298 |
| 6,446,411 | B2 * | 9/2002 | Natelli, Jr. | 52/836 |
| 6,776,377 | B1 * | 8/2004 | Watkins | 246/111 |
| 6,868,641 | B2 * | 3/2005 | Conner et al. | 52/98 |
| 7,219,873 | B2 * | 5/2007 | Harwood | 248/519 |
| 2005/0284987 | A1 * | 12/2005 | Kande et al. | 246/125 |
| 2009/0266016 | A1 * | 10/2009 | Kraft | 52/296 |
| 2009/0272053 | A1 * | 11/2009 | Dent | 52/296 |
| 2010/0108823 | A1 * | 5/2010 | Barnes | 246/111 |

OTHER PUBLICATIONS

Photograph.

* cited by examiner

*Primary Examiner* — S. Joseph Morano
*Assistant Examiner* — Jason C Smith
(74) *Attorney, Agent, or Firm* — Bracewell & Giuliani LLP

(57) ABSTRACT

A railroad crossing gate flasher assembly has a sealed, rodent-proof connection for electrical cables that pass from the foundation to a junction box. A clearance between the bottom of the junction box and the top of the foundation is sealed with a plate to prevent rodents from accessing the cables. The seal plate is mounted to the bolts that extend from the foundation and is leveled after it is inserted onto the bolts. The junction box is lowered onto the seal plate and attached to the same bolts so that the junction box also is level. The seal plate has an opening, coupling and conduit for protecting the cables.

20 Claims, 6 Drawing Sheets

SYSTEM, METHOD AND APPARATUS FOR RAILROAD GATE FLASHER ASSEMBLY HAVING A SEALED, RODENT-PROOF CONNECTION BETWEEN IN-PLACE FOUNDATION AND UTILITY MAST

BACKGROUND OF THE INVENTION

1. Technical Field

The present invention relates in general to railroad crossings for automobiles and, in particular, to a sealed, rodent-proof connection between the foundation and utility mast for a railroad gate flasher assembly at railroad crossings.

2. Description of the Related Art

At railroad grade crossings, train warning systems employ gate flasher assemblies that lower gates to keep roadway traffic off of the rails when trains pass through the crossings. The gates are typically mounted on mast assemblies that are anchored to in-place foundations in the ground. Electrical cables or wiring typically pass underground from a nearby control box, through the foundation, and up into and through a junction box located on top of the foundation to provide power and signals to a gate swing mechanism, warning lights, and bell.

In conventional gate flasher assembly designs, there is a clearance required between the bottom of the junction box and the top of the foundation to provide adequate space (e.g., a few inches) to properly level the junction box. The clearance is large enough for small rodents, such as mice, to enter and then climb up into the utility box. The rodents chew the insulation on the exposed electrical wiring and cause damage and electrical shorts in the signal lights and other electrical functions of the gate flasher assembly. To address this problem, railroad companies sometimes use expanding foam insulation to cover the space between the junction box and foundation. Although this practice is workable, an improved solution that permanently and completely seals the junction box and protects the wiring would be desirable to increase the reliability and durability of the gate flasher assembly.

SUMMARY OF THE INVENTION

Embodiments of a system, method, and apparatus for a railroad crossing gate flasher assembly having a sealed, rodent-proof connection between the foundation and utility mast are disclosed. The crossing gate flasher assembly is mounted on a foundation that is secured to the ground. Electrical cables pass from the foundation up into and through a junction box to power the gate swing mechanism, warning lights, and bell. A clearance between the bottom of the junction box and the foundation is sealed with a plate to prevent rodents from entering the junction box. The sealing plate seals and protects the wiring by preventing rodent infiltration.

In one embodiment, the seal plate is mounted to the bolts that extend from the foundation. The seal plate is leveled after it is inserted onto the bolts. The junction box is lowered onto the seal plate and attached to the same bolts. Consequently, the junction box is level because the seal plate has already been leveled. The seal plate has a central opening and electrical conduit extending downward from the opening. The conduit extends below the seal plate and provides a connection point for the electrical conduit that protrudes from underground. When the junction box is mounted to the seal plate and the conduit is coupled to the seal plate, rodents cannot infiltrate the assembly.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Figure 1:
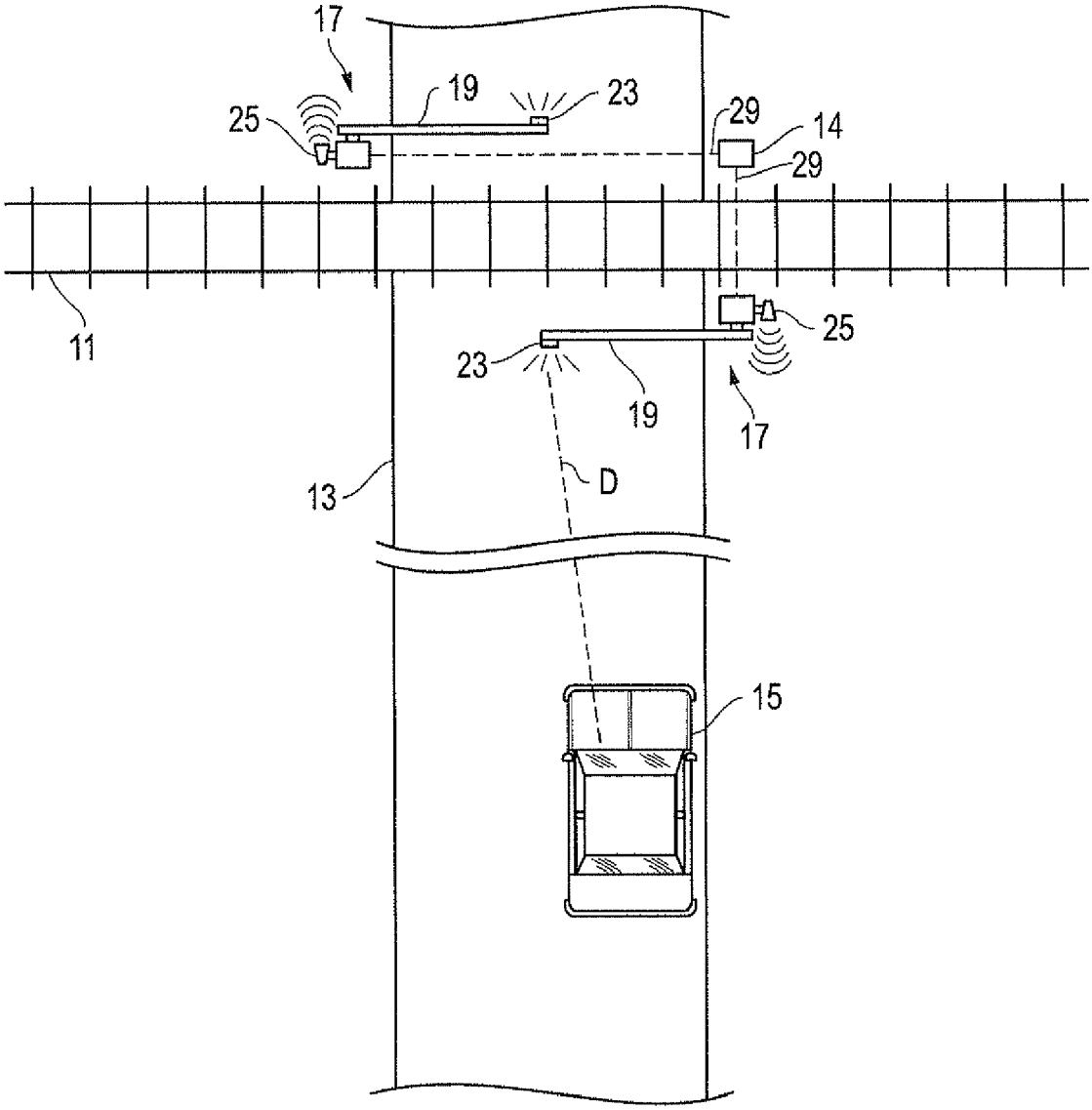
FIG. 1 is a schematic drawing of one embodiment of a gate flasher assembly at a railroad crossing and is constructed in accordance with the invention.

Referring to FIGS. 1-10, embodiments of a system, method and apparatus for a railroad crossing gate flasher assembly having a sealed, rodent-proof connection for a utility mast assembly are disclosed. As shown in FIG. 1, one embodiment of a railroad crossing comprises a railroad 11 for trains and a road 13 for roadway traffic 15 that crosses the railroad 11. One or more railroad crossing gate flasher assemblies 17 are located adjacent to an intersection between the railroad 11 and the road 13. In the configuration shown, one gate flasher assembly 17 is located on each side of the railroad 11. A control box 14 is located in the vicinity of the intersection and provides electrical power and control signals to gate flasher assemblies 17 via underground wiring 29.

In one embodiment, each of the gate flasher assemblies 17 may comprise an arm or gate 19 that is movable between a lower position (FIG. 1) that extends over the road 13 to prevent automobiles 17 from crossing the railroad 11, and an upper position (FIGS. 2 and 3) that is substantially vertical and does not extend over the road 13. The gate flasher assembly 17 also comprises a junction box 20 (e.g., a cast housing) having a gate swing mechanism 21 for moving the gate 19.

Figure 3:
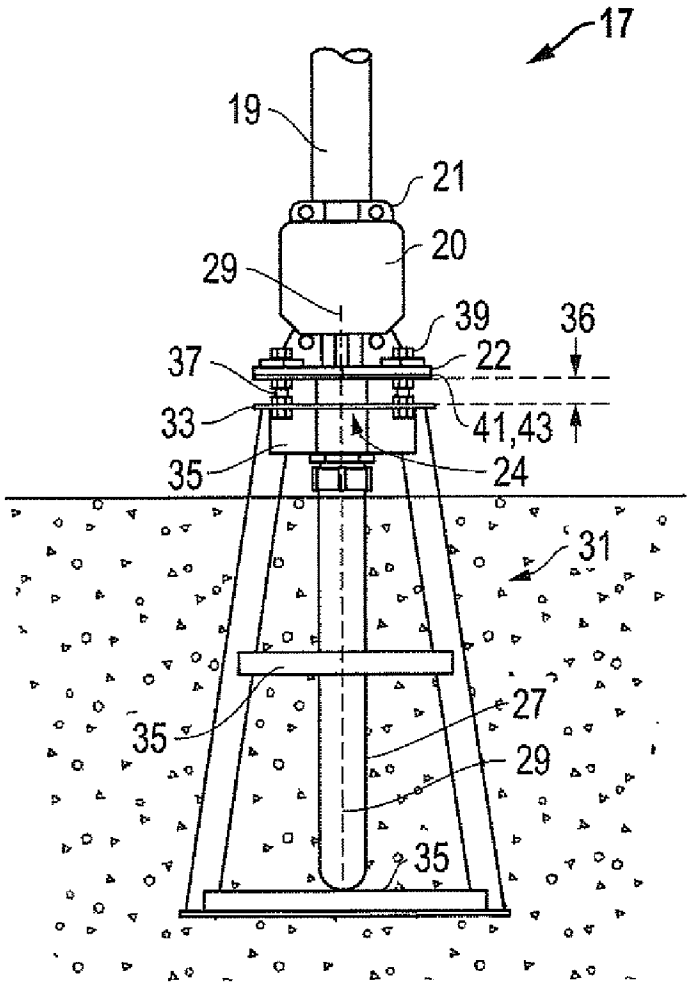
FIGS. 2 and 3 are side and end views of one embodiment of the gate flasher assembly of FIG. 1 and is constructed in accordance with the invention.
Figure 2:
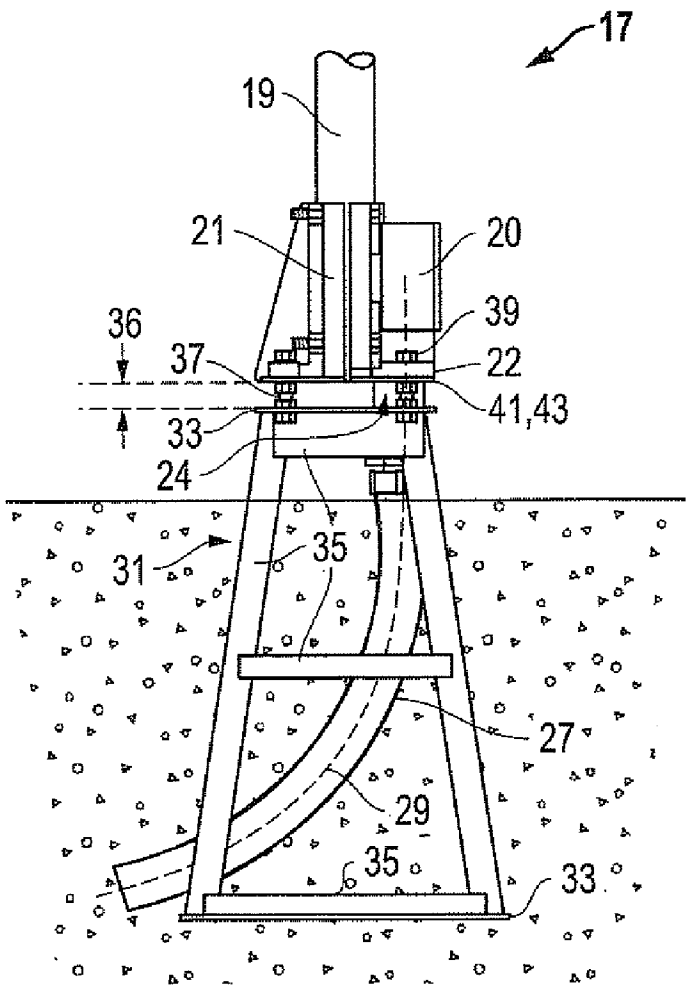
Figure 5:
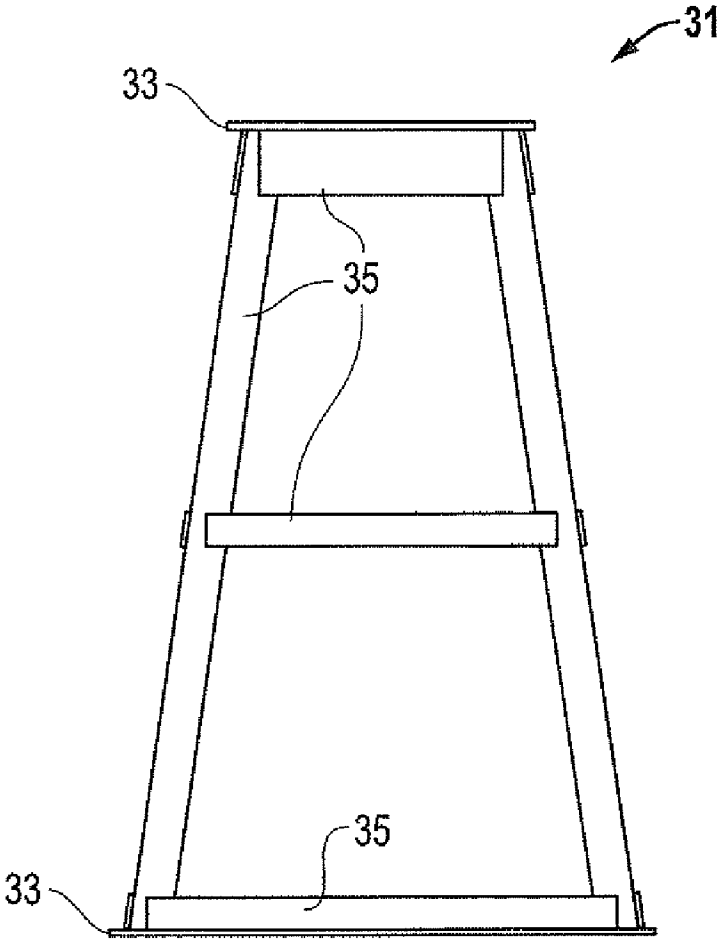
FIGS. 4 and 5 are top and side views of one embodiment of a foundation for the gate flasher assembly of FIGS. 2 and 3 and is constructed in accordance with the invention.
Figure 4:
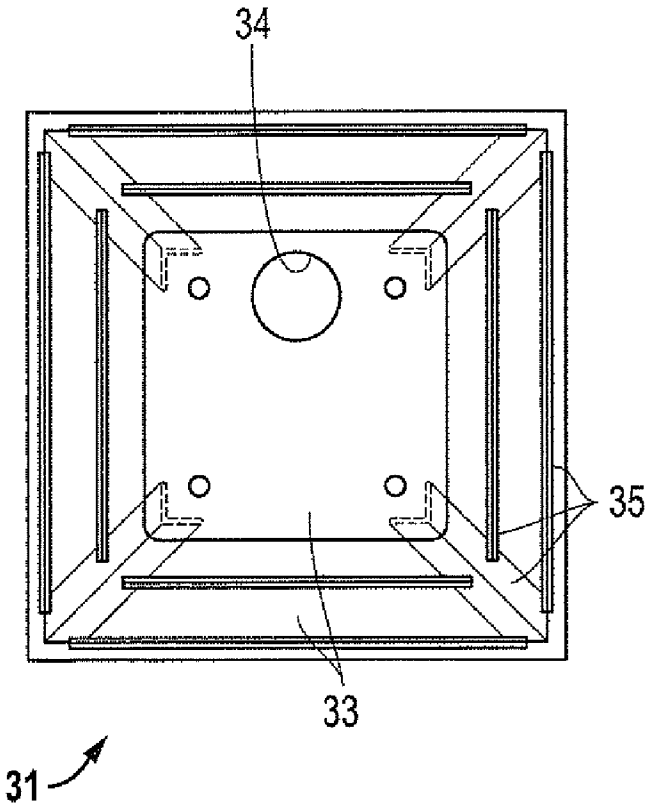
Figure 7:
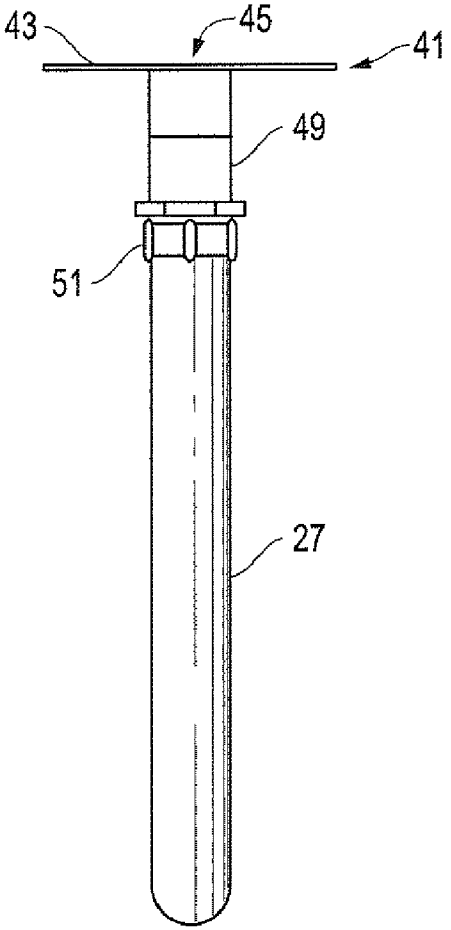
FIGS. 6 and 7 are side and end views of one embodiment of a seal plate assembly for the gate flasher assembly of FIGS. 2 and 3 and is constructed in accordance with the invention.
Figure 6:
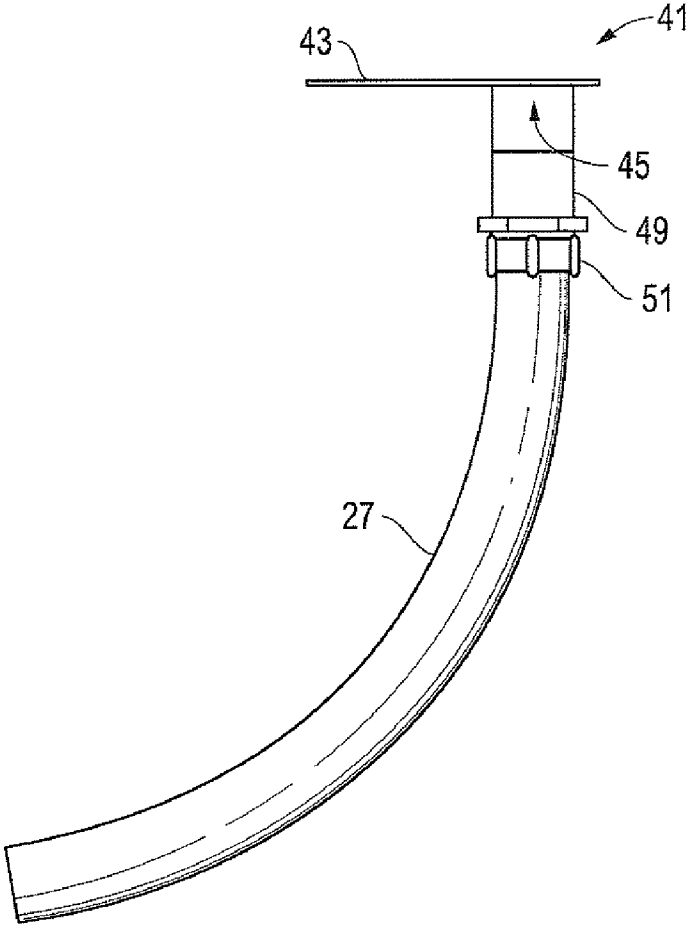

The gate flasher assembly 17 also comprises warning lights 23 (FIG. 1) and a bell 25 or other audible device. Each of these devices is provided with signals via wiring 29 (FIGS. 2 and 3). As noted previously, the wiring 29 originates from control box 14 and extends underground. When wiring 29 emerges from the ground adjacent gate flasher assembly 17, it is completely shielded and protected by an electrical conduit 27 that extends from the ground to an interior of the gate flasher assembly 17.

In the illustrated embodiments of FIGS. 2-5, each gate flasher assembly 17 also may comprise a foundation 31. The foundation 31 may comprise upper and lower horizontal plates 33 and a plurality of structural members 35 mounted therebetween. A plurality of bolts 37 (e.g., four shown) extend through bolt holes at an upper end of the foundation 31 (e.g., through upper plate 33) and extend upward above the upper end of the foundation 31 and upper plate 33. In addition, a plurality of nuts 39 are threadingly secured on each of the bolts 37 (e.g., four on each bolt). The nuts 39 are movable relative to the bolts 37 for adjusting a vertical elevation thereof. In one embodiment, each bolt 37 has one nut 39 located below upper plate 33, and three nuts 39 located above upper plate 33, such that the upper plate 33 is captured between the first and second nuts 39 on each bolt 37.

As shown in FIGS. 2 and 3, the bolts 37 and nuts 39 are used to mount the junction box 20 to the foundation 31. The junction box 20 has a lower base or flange 22 with bolt holes through which the bolts 37 extend. In one embodiment, the flange 22 is captured between the third and fourth nuts 39 on each bolt 37 as shown. The flange 22 also has an aperture 24 extending through a lower end thereof that permits access into an interior thereof for electrical wiring.

Referring now to FIGS. 2, 3 and 6-9, embodiments of the invention also comprise a seal plate 41 located on the foundation 31. The seal plate 41 has a plate 43 that is mounted to the bolts 37 between, e.g., the third and fourth nuts 39 on each bolt 37. Thus, the plate 43 directly abuts upper ones of the nuts 39 on the bolts 37 such that the plate 43 is elevated above the top of upper plate 33 by a space or clearance 36 (FIGS. 2 and 3). When leveled, the plate 43 is substantially horizontal and located above the foundation 31. The seal plate 41 may be leveled by adjustment of the nuts 39 for proper orientation of lights 23 (FIG. 1) on, e.g., gate 19. Lights 23 should be properly oriented for visibility by the drivers of roadway traffic 15 from a distance D of 500 feet.

Figure 9:
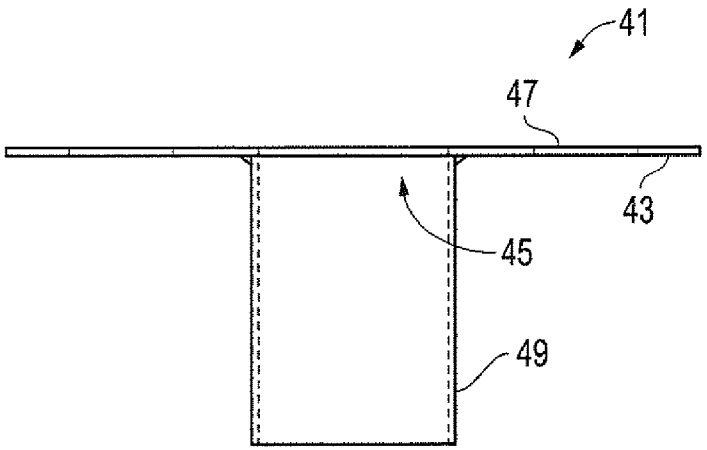
FIGS. 8 and 9 are enlarged side and end views of one embodiment of the seal plate for the seal plate assembly of FIGS. 6 and 7 and is constructed in accordance with the invention.
Figure 8:
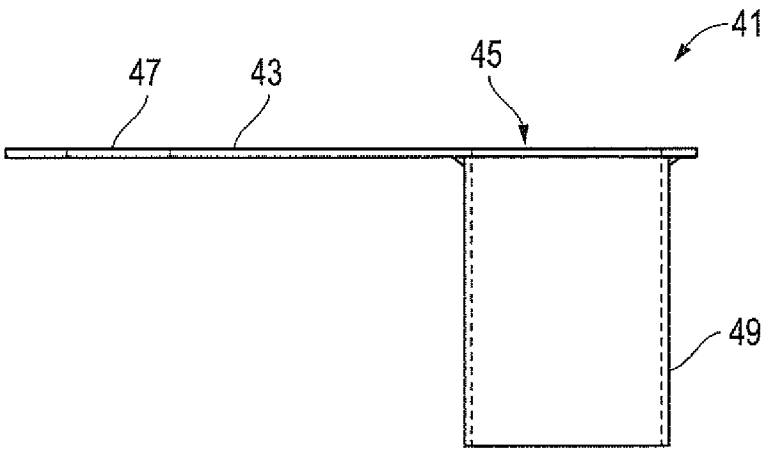
Figure 10:
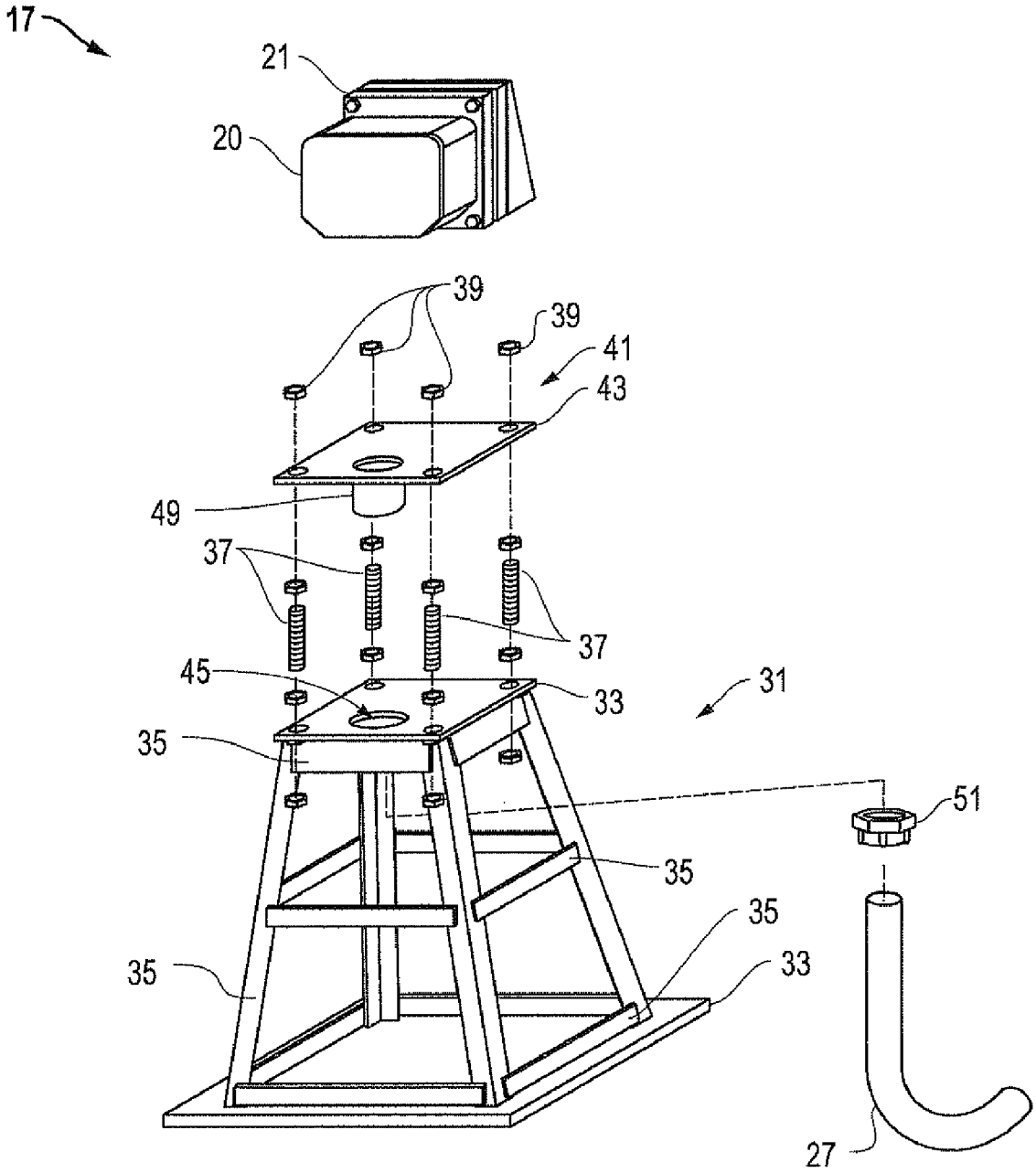
FIG. 10 is an exploded view of one embodiment of a gate flasher assembly constructed in accordance with the invention.

As best shown in FIGS. 8 and 9, the plate 43 has an opening or electrical wiring port 45 that extends therethrough and a pattern of bolt holes 47 that align with the bolt hole pattern formed on flange 22 and upper plate 33 through which the bolts 37 extend. A coupling 49 is aligned with and extends downwardly from the electrical wiring port 45 through a hole 34 (FIG. 4) in upper plate 33. The hole 34 is sufficiently large to allow articulation of coupling 49 therein when seal plate 41 is leveled. The junction box 20 is mounted on top of and directly abuts the seal plate 41, such that the junction box 20 is leveled by the leveling of the seal plate 41. In one embodiment, the junction box includes a removable cover that can be removed without removing the seal plate.

The electrical wiring 27 (see, e.g., FIGS. 2 and 3) extends downward from the junction box 20 through the aperture 24, the electrical wiring port 45 and coupling 49 of the plate 43, and within the conduit 27 extending through an interior of the foundation 31. In this way, the plate 43 and coupling 49 cover the aperture 24 in the junction box 20 to protect the wiring. In addition, a connector 51 is mounted to and located below the coupling 49 of the plate 43, and the conduit 27 is connected to and located below the connector 51 for protecting the electrical wiring 29. The conduit 27 extends from the interior of the foundation 31 to an exterior of the foundation 31.

In another embodiment, the invention may comprise a railroad crossing gate flasher assembly having a foundation adapted to be located adjacent to an intersection between a railroad for trains and a road for automobiles. A junction box is mounted to the foundation and has a gate that is movable between upper and lower positions. Electrical wiring extends downward through an aperture on a lower end, and the junction box is above and spaced apart from the foundation.

A seal plate is positioned between the foundation and the junction box and has a plate with an electrical wiring port and a coupling extending downwardly therefrom. A connector is mounted to and located below the coupling, and a conduit is connected to and located below the connector. The electrical wiring extends from the aperture and through the electrical wiring port, coupling, connector and conduit for protecting the electrical wiring from the junction box to an exterior of the foundation. In one embodiment, the coupling, connector and conduit extend through an interior of the foundation, and the conduit extends from the interior of the foundation to the exterior of the foundation.

The railroad crossing gate flasher assembly may further comprise warning lights, a bell, and a gate swing mechanism for moving the gate, the warning lights, bell and gate swing mechanism being provided with electrical power and signals by the electrical wiring. The plate may be leveled above the foundation for leveling the junction box and is substantially horizontal. For example, the plate may be leveled on bolts extending through an upper end of the foundation, and nuts on each of the bolts that are movable relative to the bolts for leveling the plate.

In still another embodiment, the invention may comprise a complete railroad crossing having a railroad for trains, and a road for vehicular traffic (e.g., automobiles) that crosses the railroad and forms an intersection therebetween. A warning system is located at the intersection for alerting drivers of automobiles of trains in a vicinity of the intersection. The warning system comprises a gate flasher assembly and a control box for distributing electrical power and control signals to the gate flasher assembly via electrical wiring. The gate flasher assembly may comprise a foundation and a junction box mounted to the foundation with the electrical wiring extending downward through an aperture on a lower end, the junction box being above and spaced apart from the foundation.

A seal plate is positioned between the foundation and the junction box and comprises a plate having an electrical wiring port with a coupling extending downwardly therefrom, a connector mounted below the coupling, and a conduit mounted below the connector, such that the electrical wiring extends from the aperture and through the electrical wiring port, coupling, connector and conduit for protecting the electrical wiring from the junction box to the control box.

In yet another embodiment, a utility mast assembly comprises a foundation, a plurality of bolts extend through an upper end of the foundation and extending upward above the upper end of the foundation. A plurality of nuts are on each of the bolts, and the nuts are movable relative to the bolts for adjusting their vertical elevation. A seal plate is located on the bolts and directly abuts upper ones of the nuts on the bolts.

The seal plate comprises a flat plate that is substantially horizontal and located above the upper end of the foundation and which is leveled by adjustment of the nuts. The plate has an electrical wiring port that extends therethrough, and a pattern of bolt holes through which the bolts extend. A coupling is aligned with and extends downwardly from the electrical wiring port away from the plate. A junction box is mounted on top of and directly abutting the seal plate. The junction box has a pattern of bolt holes that align with the pattern of bolt holes in the plate and through which the bolts extend, and electrical wiring extending downward through an aperture on the lower end of the junction box, the electrical wiring port and coupling of the plate, and an interior of the foundation, such that the plate and coupling otherwise cover the aperture in the junction box.

In still another embodiment, the invention may comprise a utility mast assembly having a utility mast that extends in a vertical direction above ground with a junction box at a lower end thereof. The junction box includes a bottom aperture through which electrical wires extend up into the utility mast. As illustrated in the various drawings, an in-place foundation is adapted to be preassembled and buried in the ground to form a foundation for supporting the utility mast in the vertical direction.

A seal plate is positioned between the foundation and the junction box, and is attached to the foundation with a gap therebetween so that the seal plate can be leveled relative to the foundation. The seal plate also is attached to the junction box and comprises a plate having an electrical wiring port with a coupling extending downwardly therefrom, a connector mounted to and located below the coupling, and a conduit connected to and located below the connector. The electrical wiring extends from the aperture and through the electrical wiring port, coupling, connector and conduit, such that the seal plate, coupling and connector form a rodent-proof seal between the junction box and the conduit. The junction box may include a removable cover that can be removed without removing the seal plate.

While the invention has been shown or described in only some of its forms, it should be apparent to those skilled in the art that it is not so limited, but is susceptible to various changes without departing from the scope of the invention.

I claim:

1. A gate flasher assembly for a railroad crossing, comprising:

a foundation having a top surface located above a ground surface;

a substantially horizontal plate having a first aperture positioned on the top surface of the foundation;

a junction box positioned above the foundation having electrical wiring extending downward through the first aperture of the substantially horizontal plate;

a seal plate positioned between the substantially horizontal plate and the junction box such that a clearance is formed between the seal plate and the substantially horizontal plate, the seal plate including a second aperture, and a tubular conduit extending downwardly from the second aperture through the first aperture of the substantially horizontal plate such that the electrical wiring from the junction box extends across the clearance between the seal plate and the substantially horizontal plate through the conduit, and the junction box being mounted on top and abutting the seal plate and having a same bolt hole pattern as a bolt hole pattern in the seal plate and through which bolts extend.

2. A gate flasher assembly according to claim 1, further comprising warning lights, a bell, and a gate swing mechanism for moving a gate between a lower position that is substantially horizontal and an upper position that is substantially vertical, wherein the warning lights, bell and gate swing mechanism are provided with power and signals by the electrical wiring.

3. A gate flasher assembly according to claim 1, wherein the electrical wiring extends below the ground surface through a tubular passageway extending from the conduit.

4. A gate flasher assembly according to claim 1, wherein a positioning of the seal plate with respect to the substantially horizontal plate may be changed to level the junction box.

5. A gate flasher assembly according to claim 4, wherein the junction box is leveled using bolts that extend through the seal plate and the substantially horizontal plate.

6. A railroad crossing gate flasher assembly, comprising:

a foundation adapted to be located adjacent to an intersection between a railroad for trains and a road for automobiles, a top surface of the foundation including a substantially horizontal plate having an aperture;

a junction box mounted above the foundation and having a gate that is movable between upper and lower positions, electrical wiring extending downward through the aperture on the substantially horizontal plate, the junction box being spaced apart from the foundation;

a seal plate supporting the junction box located above the foundation such that a clearance is formed between the substantially horizontal plate and the seal plate, the seal plate including a tubular conduit extending downwardly through the clearance and the aperture of the substantially horizontal plate such that electrical wiring from the junction box extends across the clearance through the tubular conduit; and a plurality of bolts extending across the clearance to couple the seal plate and the substantially horizontal plate, wherein a positioning of the seal plate with respect to the upper horizontal plate may be varied using the bolts, and the junction box being mounted on top and abutting the seal plate and having a same bolt hole pattern as a bolt hole pattern in the seal plate and through which said bolts extend.

7. A railroad crossing gate flasher assembly according to claim 6, wherein a tubular passageway extends through an interior of the foundation to below a ground surface to direct the electrical wires from the junction box therethrough.

8. A railroad crossing gate flasher assembly according to claim 6, further comprising warning lights, a bell, and a gate swing mechanism for moving the gate, the warning lights, bell and gate swing mechanism being provided with electrical power and signals by the electrical wiring.

9. A railroad crossing gate flasher assembly according to claim 6, wherein the positioning of the seal plate with respect to the substantially horizontal plate is adjustable for leveling the junction box.

10. A railroad crossing gate flasher assembly according to claim 9 further including a plurality of nuts coupled to each bolt of the plurality of bolts, wherein the junction box is leveled by turning at least one nut of the plurality of nuts.

11. A utility mast assembly, comprising:

a foundation having a top surface including a substantially horizontal plate with an aperture;

a plurality of bolts extending upwards through the substantially horizontal plate;

a plurality of nuts on each of the bolts, the nuts being movable relative to the bolts for adjusting a vertical elevation thereof;

a seal plate located on the bolts and spaced above the substantially horizontal plate of the foundation to make an air gap therebetween, wherein a positioning of the seal plate with respect to the substantially horizontal plate may be changed by adjustment of the nuts, and the seal plate includes a pattern of bolt holes through which the bolts extend, and a tubular conduit extending downwardly from the seal plate through the aperture of the substantially horizontal plate; and a junction box mounted on top of and directly abutting the seal plate, the junction box having a pattern of bolt holes that align with the pattern of bolt holes in the seal plate and through which the bolts extend, and electrical wiring extending downward and across the air gap through the tubular conduit.

12. A utility mast assembly according to claim 11, further comprising a tubular passageway coupled to and located below the tubular conduit of the seal plate for protecting the electrical wiring.

13. A utility mast assembly according to claim 11, further comprising a gate swing mechanism for moving a gate, warning lights, and a bell that are provided with electrical power by the electrical wiring.

14. A utility mast assembly, comprising:

a utility mast extending in a vertical direction above ground and having a junction box at a lower end thereof, the junction box including a bottom aperture through which electrical wires extend up into the utility mast;

an in-place foundation adapted to be preassembled and buried in the ground to form a foundation for supporting the utility mast in the vertical direction, a top surface of the foundation including a substantially horizontal plate with a first aperture;

a seal plate positioned between the foundation and the junction box, the seal plate being attached to the foundation but leaving a gap therebetween so that the seal plate can be leveled relative to the foundation, the seal plate also being attached the junction box, the seal plate including a second aperture with a tubular conduit extending downwardly through the first aperture of the substantially horizontal plate, and a tubular passageway coupled the tubular conduit such that the electrical wiring extends from the bottom aperture of the junction box passes through the tubular conduit and the tubular passageway to form a rodent-proof seal, and the junction box being mounted on top and abutting the seal plate and having a same bolt hole pattern as a bolt hole pattern in the seal plate and through which bolts extend.

15. The utility mast of claim 14 wherein the junction box includes a removable cover that can be removed without removing the seal plate.

16. The utility mast of claim 14 further including a plurality of bolts coupling the substantially horizontal plate, and the seal plate is adjustable relative to the foundation by adjusting a bolt of the plurality of bolts.

17. The utility mast of claim 14 wherein the first aperture of the substantially horizontal plate includes a substantially circular shape.

18. The utility mast of claim 14, wherein the second aperture of the seal plate is aligned with the first aperture of the substantially horizontal plate.

19. The utility mast of claim 14, wherein the tubular passageway extends below the ground.

20. The utility mast of claim 14 further including warning lights that are provided with electrical power by the electrical wiring.

* * * * *